US012685364B2

(12) United States Patent
Issa et al.

(10) Patent No.: US 12,685,364 B2
(45) Date of Patent: Jul. 21, 2026

(54) SIZE-ADJUSTABLE WOVEN FABRIC, WEARABLE ITEM AND METHODS OF RESIZING A FABRIC

(71) Applicant: Nano Textile Solutions AB, Linköping (SE)

(72) Inventors: Samer Issa, Linköping (SE); Erik Khranovskyy, Linköping (SE); Mykhailo Zhybak, Linköping (SE)

(73) Assignee: Nano Textile Solutions AB, Linköping (SE)

( * ) Notice: Subject to any disclaimer, the term of this patent is extended or adjusted under 35 U.S.C. 154(b) by 556 days.

(21) Appl. No.: 18/029,856

(22) PCT Filed: Oct. 8, 2021

(86) PCT No.: PCT/EP2021/077876
§ 371 (c)(1),
(2) Date: Mar. 31, 2023

(87) PCT Pub. No.: WO2022/074203
PCT Pub. Date: Apr. 14, 2022

(65) Prior Publication Data

US 2023/0354951 A1 Nov. 9, 2023

(30) Foreign Application Priority Data

Oct. 8, 2020 (SE) ..... 2051177-0
Sep. 28, 2021 (SE) ..... 2151187-8

(51) Int. Cl.
*A43B 3/26* (2006.01)
*A41D 13/05* (2006.01)
(Continued)

(52) U.S. Cl.
CPC ..... *A43B 3/26* (2013.01); *A41D 13/05* (2013.01); *A41D 31/24* (2019.02); *A43B 1/05* (2022.01)

(58) Field of Classification Search
CPC .... A43B 3/24; A43B 3/34; A43B 3/26; A43B 1/05; A41D 31/24; A41D 13/05
See application file for complete search history.

(56) References Cited

U.S. PATENT DOCUMENTS 4,036,924 A 7/1977 Shishoo et al.
4,369,356 A 1/1983 Tsurutani et al.
(Continued)

FOREIGN PATENT DOCUMENTS

CN 104902598 A 9/2015
EP 0501799 A2 9/1992
(Continued)

OTHER PUBLICATIONS

International Search Report and Written Opinion for International Application No. PCT/EP2021/077876, mailed Jan. 21, 2022, (16 pages).
(Continued)

*Primary Examiner* — Alicia J Weydemeyer
*Assistant Examiner* — Laura B Figg
(74) *Attorney, Agent, or Firm* — Kagan Binder, PLLC

(57) ABSTRACT

A size-adjustable woven fabric comprises a first set of threads (10*a*-10*i*), each formed of a heat-shrink polymer material, at least one conducting thread (20), formed of an electrically conducting material, wherein the first set of threads (10*a*-10*i*) runs substantially parallel with each other, and wherein the conducting thread (20) runs substantially across the first set of threads (10*a*-10*i*). There is further disclosed a wearable item comprising such a size-adjustable fabric, as well as methods of expanding and reducing size of
(Continued)

such a size-adjustable fabric. There is further disclosed footwear and protective wear comprising such size-adjustable fabric.

19 Claims, 7 Drawing Sheets

(51) Int. Cl.
*A41D 31/24* (2019.01)
*A43B 1/05* (2022.01)

(56) References Cited

U.S. PATENT DOCUMENTS

| | | | | |
|---|---|---|---|---|
| 5,236,765 | A * | 8/1993 | Cordia | B29C 65/3428 219/535 |
| 9,290,876 | B2 | 3/2016 | Marcellin et al. | |
| 9,462,891 | B2 | 10/2016 | Kikuchi et al. | |
| 2013/0260630 | A1 | 10/2013 | Ito et al. | |
| 2017/0280819 | A1 | 10/2017 | Corbeil et al. | |
| 2018/0168277 | A1* | 6/2018 | Sussmann | A43B 23/0235 |
| 2018/0368524 | A1 | 12/2018 | Taniguchi et al. | |
| 2019/0017199 | A1* | 1/2019 | Granberry | D04B 1/26 |

FOREIGN PATENT DOCUMENTS

| | | | |
|---|---|---|---|
| FR | 2584744 | A1 | 1/1987 |
| SE | 395599 | B | 8/1977 |
| WO | 0234988 | A2 | 5/2002 |

OTHER PUBLICATIONS

Swedish Search Report for Swedish Application No. 2051177-0, mailed Mar. 9, 2021, (2 pages).

* cited by examiner

SIZE-ADJUSTABLE WOVEN FABRIC, WEARABLE ITEM AND METHODS OF RESIZING A FABRIC

CROSS-REFERENCE TO RELATED APPLICATIONS

This application claims priority to International Application No. PCT/EP2021/077876, filed Oct. 8, 2021 and titled "SIZE-ADJUSTABLE WOVEN FABRIC, WEARABLE ITEM AND METHODS OF RESIZING A FABRIC," which in turn claims priority from a Swedish Patent Application having serial number 2051177-0, filed Oct. 8, 2020; and Swedish Patent Application having serial number 2151187-8, filed Sep. 28, 2021, all of which are incorporated herein by reference in their entireties.

TECHNICAL FIELD

The present disclosure relates to a resizeable fabric, and in particular to a fabric which can be repeatedly resized and which can be resized to any size within an interval of sizes.

The disclosure further relates to a wearable item, such as a garment, a harness or the like, which can be resized using such resizeable fabric.

The disclosure also relates to methods of resizing a fabric.

The disclosure further relates to footwear, and to liners for footwear, which can be resized and/or fine-tuned with respect to size.

BACKGROUND

There are many applications, where it may be desirable to be able to resize an item made of textile in order to achieve an optimum fit to a wearer, or to achieve a one-size-fits-all item.

For example, various garments, such as suits, jackets, pants, etc. need to be produced in a large number of sizes. In addition, they may frequently need to be adjusted by a tailor to fit the wearer.

Some items may be provided with size adjustment mechanisms, such as straps and buckles, hook-and-loop type fasteners, elastic insets, cuffs or sleeves, etc.

In particular for expensive wearable items, such as cooling vests, stab-proof vests, bullet proof vests, equipment harnesses, and similar equipment, which need to fit perfectly on the user to provide optimum function, there is a need for improved size-adjustment devices.

For example, US20070042660A1, GB2441589A and EP3511454A1 disclose various uses of shape memory alloys, which are integrated into the fabric in order to provide a fabric that is capable of changing size.

However, such solutions are adjustable between a few discrete positions, which limits their usefulness.

There is a need for improved solutions for changing the size of garments and other wearable items.

SUMMARY

It is an object of the present disclosure to provide an improved concept for size-adjustable garments and other wearable items. One particular object is to provide a concept that enables improved one-size-fits-all items, or at least "one-size-fits-many" items.

The invention is defined by the appended independent claims, with embodiments being set forth in the dependent claims, in the following description and in the appended drawings.

According to a first aspect, there is provided a size-adjustable woven fabric comprising a first set of threads, each formed of a heat-shrink polymer material, at least one conducting thread, formed of an electrically conducting material, wherein the first set of threads runs substantially parallel with each other, and wherein the conducting thread runs substantially across the first set of threads.

The term "substantially parallel" means parallel, except for minor variations.

The term "substantially across" means across, except for at areas where the conducting thread turns.

A heat-shrink polymer material may be a polymer material which during production has been treated, e.g. by cross linking, typically by ionizing radiation, so as to provide an original state, and subsequently expanded during heating to above its crystalline melting point, so as to create an expanded state, and then rapidly cooled. The expanded heat-shrink polymer material has the ability to return to its original state when it is heated above the crystalline melting point.

Heat-shrink polymer materials are known as such.

Hence, unlike a shape memory polymer, which transforms between two or three distinct configurations, a heat-shrink polymer is able to take on any configuration between its original state and an expanded state.

Hence, by using a heat-shrink polymer, it is possible to provide a size-adjustable fabric, which can be adjusted over a continuum of sizes. Moreover, it is possible to provide a size-adjustable fabric, which can be repeatedly resized, either by reduction or expansion of the fabric.

A combination of threads formed from one or more heat-shrink polymer materials can be heated by means of a conducting thread. By using a heat-shrink material, the length of the first set of threads can be extended and reduced by means of heating by the conducting thread while selectively applying a load to the first set of threads. The first set of threads may form a set of warp threads, and the conducting thread may form a weft thread.

The conducting thread may, except for at its turns, extend at an angle of approximately 80-100 degs to the first set of threads.

Heat-shrink polymer materials can be made of a range of polymer materials, including polyolefin, polyester, polyvinyl chloride (PVC), fluorocarbon-based synthetic rubber (such as Viton® by The Chemours Company), polychloroprene rubber, polytetrafluoroethylene (PTFE), elastomers, fluorinated ethylene propylene (FEP) and polyvinylidene fluoride (PVDF).

The heat-shrink polymer material may be a crosslinked and subsequently expanded polymer material.

Such cross-linking may be achieved through irradiation.

As non-limiting examples, heat-shrink polyolefins may be operated at a contraction temperature of 90-120 deg C. and at expansion temperatures of 120-145 deg C.

As further non-limiting examples, heat-shrink polyvinylchlorides may be operated at a contraction temperature of about 100 deg C. and at an expansion temperatures of about 120 deg C.

As further non-limiting examples, heat-shrink PVDF may be operated at a contraction temperature of about 170 deg C. and at expansion temperatures of about 210 deg C.

The may further comprise at least one further non-conducting thread, which extends mainly parallel with the conducting thread.

The conducting thread may run may across the entire first set of threads.

Alternatively, the conducting thread may, at least at some section along a length direction of the first set of threads, run across less than all threads of the first set of threads.

The threads of the first set of threads may present at least two different lengths.

The fabric may further comprise at least one expansion limiting thread, which extends parallel with the first set of threads, wherein the expansion limiting thread, when the first set of threads are in a contracted state, present curved portions between crossing portions of the conducting thread.

Alternatively, the conducting thread may form a warp thread and the first set of threads may form weft threads.

According to a second aspect, there is provided a wearable item, comprising:

a first flexible fixed-size fabric portion, a second flexible fixed-size fabric portion, and a patch, formed of a size-adjustable fabric as claimed in any of the preceding claims, arranged between and connecting said first and second fixed-size fabric portions, wherein the first set of threads extend at a greater angle (at) to an edge of at least one of the first and second fixed-size fabric portions than the conducting thread.

According to a third aspect, there is provided a method of enlarging a size of a fabric as disclosed above. The method comprises supplying a current through the conducting thread, for a time sufficient to heat the first set of threads to an expansion temperature, said expansion temperature being in an interval from a melting temperature of the heat-shrink polymer material to the melting temperature plus 200 degs, applying a tensile force in a direction substantially parallel with an extent of the first set of threads when said expansion temperature has been reached, expanding the fabric in said direction to a first desired degree of expansion, preferably 110-250%, while maintaining said expansion temperature, and subsequently allowing the expanded fabric to cool to a temperature lower by at least 50 degs than the melting temperature of the heat-shrink polymer material.

The method may further comprise supplying a current through the conducting thread, for a time sufficient to heat the first set of threads to a contraction temperature, said contraction temperature being in an interval from the melting temperature of the heat-shrink polymer material minus 50 degs to the melting temperature plus 10 degs, allowing the fabric to shrink while maintaining said contraction temperature, subsequently allowing the contracted fabric to cool to a temperature lower by at least 50 degs than the melting temperature of the heat-shrink polymer material, supplying a current through the conducting thread, for a time sufficient to heat the first set of threads to the expansion temperature, applying a tensile force in a direction substantially parallel with an extent of the first set of threads when said expansion temperature has been reached, expanding the fabric in said direction to a desired second degree of expansion, preferably 110-250% while maintaining said expansion temperature, and subsequently allowing the expanded fabric to cool to a temperature lower by at least 50 degs than the melting temperature of the heat-shrink polymer material, wherein said second degree of expansion is different from said first degree of expansion.

The expansion temperature may be in an interval selected from a group consisting of $T_m$+0 degs to $T_m$+5 degs; $T_m$+5 degs to $T_m$+10 degs; $T_m$+10 degs to $T_m$+15 degs; $T_m$+15 degs to $T_m$+20 degs; $T_m$+20 degs to $T_m$+30 degs; $T_m$+30 degs to $T_m$+40 degs; $T_m$+40 degs to $T_m$+50 degs; $T_m$+50 degs to $T_m$+60 degs; $T_m$+60 degs to $T_m$+80 degs; $T_m$+80 degs to $T_m$+100 degs; $T_m$+100 degs to $T_m$+125 degs; $T_m$+125 degs to $T_m$+150 degs; $T_m$+150 degs to $T_m$+175 degs; and $T_m$+175 degs to $T_m$+200 degs.

The contraction temperature may be in a range selected from a group consisting of $T_m$−50 degs to $T_m$−40 degs; $T_m$−40 degs to $T_m$−30 degs; $T_m$−30 degs to $T_m$−20 degs; $T_m$−20 degs to $T_m$−10 degs; $T_m$−10 degs to $T_m$; $T_m$ to $T_m$+5 degs; and $T_m$+5 degs to $T_m$+10 degs.

Hence, the contraction temperature may be slightly, such as no more than 10 degs or no more than 5 degs, above the melting temperature of the heat-shrink polymer material.

In the shrinking step, the first set of thread should be practically unloaded, i.e. the force applied on the first set of threads should be lower than a shrink force achievable by the first set of threads.

According to a fourth aspect, there is provided a method of reducing a size a fabric as described above. The method comprises supplying a current through the conducting thread, for a time sufficient to heat the first set of threads to a contraction temperature, allowing the fabric to shrink while maintaining said contraction temperature, and subsequently allowing the expanded fabric to cool a temperature lower by at least 50 degs than the crystalline melting point of the heat-shrink polymer material.

According to a fifth aspect, there is provided a footwear, comprising a first flexible fixed-size material portion, a second flexible fixed-size material portion, and a patch, formed of a size-adjustable fabric as described above, arranged between and connecting said first and second fixed-size material portions, wherein the patch is positioned at a shaft portion of the footwear, and wherein the first set of threads extend substantially along a circumference direction of a shaft of the footwear, such that a shaft width is adjustable.

According to a sixth aspect, there is provided a footwear, comprising a first flexible fixed-size material portion, a second flexible fixed-size material portion, and a patch, formed of a size-adjustable fabric as described above, arranged between and connecting said first and second fixed-size material portions, wherein the patch is positioned at a toe portion of the footwear, and wherein the first set of threads extend substantially along a width direction of the footwear, such that a width and/or height of the footwear is adjustable.

Footwear as referred to above may include shoes and boots, as well as liners for shoes and boots.

According to a seventh aspect, there is provided a protective wear, comprising a first protecting body, a second protecting body, and a patch, formed of a size-adjustable fabric as described above, arranged between and connecting said first and second protecting bodies, wherein the first set of threads extend substantially between the first and second protecting bodies, such that a distance between the protecting bodies is adjustable.

Protective wear as referred to above may include protective wear for sports, such as skiing, motorcycling, riding, ice hockey, etc. and may the form of back protectors, front protectors, shoulder protectors, knee protectors, elbow protectors, etc. In such cases the protection bodies may include various polymeric and/or metallic materials intended to absorb and/or distribute shock, and/or for preventing penetration of sharp objects or edges.

Protective wear may also be provided for police or military use, such as for riot wear and/or ballistic protection.

In such cases the protecting bodies may include ballistic protection material, such as woven, knitted or nonwoven fabrics, laminates, and composites which are used for ballistic protection, and/or ballistic armor plates.

According to an eighth aspect, there is provided a footwear, comprising a first flexible fixed-size material portion, a second flexible fixed-size material portion, and a patch, formed of a size-adjustable fabric as described above, arranged between and connecting said first and second fixed-size material portions. The patch is positioned at a rear portion of the footwear, and the first set of threads extend in a direction substantially parallel with a footbed of the footwear, such that a length of the footwear is adjustable.

The patch may extend upwardly from the footbed and at least past a heel portion of the footwear, preferably substantially to a collar portion of the footwear.

According to a ninth aspect, there is provided a footwear, comprising a flexible fixed-size material portion, a portion formed of a size-adjustable fabric as described above, connected with the flexible fixed-size material portion. The portion is positioned at a toe portion of the footwear, and the first set of threads extend substantially along a length direction of the footwear, such that a length of the footwear is adjustable.

According to a tenth aspect, there is provided a footwear, comprising a first flexible fixed-size material portion, a second flexible fixed-size material portion, and a patch, formed of a size-adjustable fabric as described above, arranged between and connecting said first and second fixed-size material portions, wherein the patch is positioned at a vamp or instep portion of the footwear, and wherein the first set of threads extend in a direction substantially parallel with a footbed of the footwear, such that a length of the footwear is adjustable.

Such footwear may be a shoe or a boot, or the like. In particular, the footwear may also be a liner for a shoe or a boot.

DETAILED DESCRIPTION

Figure 1:
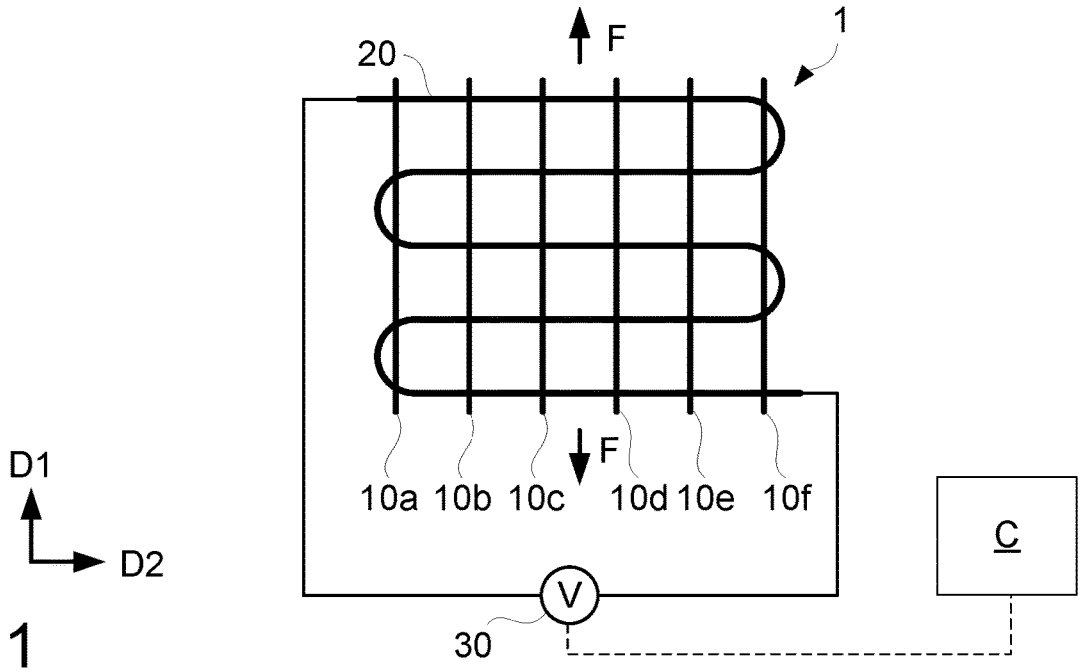
FIG. 1 is a schematic illustration of a first embodiment of a size-adjustable woven fabric.

FIG. 1 is a schematic illustration of a size-adjustable woven fabric 1 according to a first embodiment.

The fabric illustrated in FIG. 1 comprises a first set of threads, which in the illustrated example form warp threads 10*a*-10*f*, which extend substantially parallel with each other in a first direction D1. The fabric further comprises a conducting thread 20, which in the illustrated example forms a weft thread, in that it runs back and forth across the warp threads 10*a*-10*f*.

As seen in the first direction D1 and along one of the warp threads 10*a*-10*f*, the weft thread 20 will alternatingly run above and below the warp thread.

Similarly, as seen in a second direction D2 and across the warp threads 10*a*-10*f*, the weft thread 20 will alternatingly run above and below the warp threads.

The first set of threads 10*a*-10*f* are formed from a heat-shrink polymer material.

Heat-shrink polymer materials are known as such, and can be formed based on various types of polymers or polymer combinations. The heat-shrink property may be achieved in two principal ways: by radiation induced cross linking or by chemically induced crosslinking, with ionizing radiation type crosslinking being the currently predominant method used.

Each of the threads 10*a*-10*f* may be formed from one or more filaments.

A cross section of the threads may be circular, oval or polygonal, such as rectangular. A major dimension of the cross section may be on the order of 0.1-5 mm.

The conducting thread 20 is formed from a conductive and resistive material, i.e. a material which heats ups when an electric current is passed through it.

The conducting thread 20 may comprise a metallic material.

The conducting thread 20 may be formed from one or more filaments.

As another option, the conducting thread 20 may be formed from a non-conducting material, which is impregnated with a conducting material. For example, it would be possible to impregnate a multifilament thread with a metallic or organic conducting material, including carbon based materials, such as graphite or graphene.

The conducting thread 20 may be electrically insulated, e.g. by being coated or by being spun with one or more non-conducting threads or filaments. However, it is desirable that the conducting thread is in sufficient contact with the first set of threads 10*a*-10*f* to enable heat conduction from the conducting thread to the first set of threads 10*a*-10*f*.

The conducting thread 20 extends continuously over at least a portion of the fabric 1. A voltage source 30 is connectable to the respective ends of the conducting thread 20, such that a voltage may be applied to the conducting thread.

A controller C may be connectable to the voltage source 30 for controlling the voltage applied by the voltage source 30.

The controller C may be configured to control the voltage source to supply an expansion voltage, i.e. a voltage which heats the conducting thread sufficiently for it to provide an amount of heat that allows the heat-shrink to reach an expansion temperature at which the polymer material can be expanded.

The expansion temperature $T_e$ is typically based on the melting temperature $T_m$ of the polymer material(s) from which the first set of threads 10*a*-10*f* is/are formed.

In particular, the expansion temperature $T_e$ is typically equal to or greater than the melting temperature $T_m$ of the polymer material.

For some thermoplastic materials, such as polyolefins, the expansion temperature $T_e$ may be in an interval which is 0-60 degs greater than the melting temperature of the material, and preferably 20-60 degs or 20-40 degs, greater than the melting temperature.

However, for some materials, such as PTFE type materials, the expansion temperature $T_e$ may be in an interval that is 100-200 degs greater than the melting temperature of the material, and preferably 150-200 degs greater than the melting temperature.

In various embodiments, the expansion temperature $T_e$ may be in an interval that has a lower value and an upper value.

The table below lists lower and upper values for the expansion temperature $T_e$ intervals, wherein the upper limit of the $T_e$ value will always be higher than the lower limit value of the $T_e$ value. From the table, the lower limit interval may be selected from the left column and the upper limit interval may be selected from the right column. The lower and upper limit intervals may be freely selected from the left and right columns, respectively.

The $T_e$ interval (from lower limit to upper limit) may be a range of less than 50 degs, preferably less than 40 degs, less than 30 degs, less than 20 degs or less than 10 degs.

The expansion temperature $T_e$ may be in the interval $T_m$+0 degs to $T_m$+200 degs. In particular embodiments, the expansion temperature $T_e$ may be in a range selected from a group consisting of $T_m$+0 degs to $T_m$+5 degs; $T_m$+5 degs to $T_m$+10 degs; $T_m$+10 degs to $T_m$+15 degs; $T_m$+15 degs to $T_m$+20 degs; $T_m$+20 degs to $T_m$+30 degs; $T_m$+30 degs to $T_m$+40 degs; $T_m$+40 degs to $T_m$+50 degs; $T_m$+50 degs to $T_m$+60 degs; $T_m$+60 degs to $T_m$+80 degs; $T_m$+80 degs to $T_m$+100 degs; $T_m$+100 degs to $T_m$+125 degs; $T_m$+125 degs to $T_m$+150 degs; $T_m$+150 degs to $T_m$+175 degs; and $T_m$+175 degs to $T_m$+200 degs.

The contraction temperature $T_c$ is typically also based on the melting temperature $T_m$ of the polymer material(s) from which the first set of threads 10*a*-10*f* is/are formed.

In particular, the contraction temperature $T_c$ is typically approximately equal to or below the melting temperature $T_m$ of the polymer material.

For some thermoplastic materials, such as polyolefins, the contraction temperature $T_c$ may be in an interval which is 0-40 degs, preferably 0-30 degs or 0-20 degs, below the melting temperature of the material. However, contraction temperatures $T_c$ may be also in the interval 0-10 degs greater than the melting temperature, preferably 0-5 degs greater than the melting temperature $T_m$.

However, for some materials, such as PTFE type materials, the contraction temperature $T_c$ may considerably higher than the melting temperature.

The $T_c$ interval (from lower limit to upper limit) may be a range of less than 50 degs, preferably less than 40 degs, less than 30 degs, less than 20 degs or less than 10 degs.

In most cases, the contraction temperature $T_c$ may be in the interval $T_m$+50 degs to $T_m$+10 degs. In particular embodiments, the contraction temperature $T_c$ may be in a range selected from a group consisting of $T_m$−50 degs to $T_m$−40 degs; $T_m$−40 degs to $T_m$−30 degs; $T_m$−30 degs to $T_m$−20 degs; $T_m$−20 degs to $T_m$−10 degs; $T_m$−10 degs to $T_m$; $T_m$ to $T_m$+5 degs; and $T_m$+5 degs to $T_m$+10 degs.

The controller C may also be configured to control the voltage source to supply a contraction voltage, i.e. a voltage which heats the conducting thread sufficiently for it to provide an amount of heat that allows the heat-shrink polymer material to contract.

The contraction voltage may be lower than the expansion voltage.

The size of the fabric 1 may be expanded as follows.

From an original state of the heat-shrink polymer from which the warp threads 10*a*-10*f* are formed, the voltage source is controlled to provide an expansion voltage to the conducting thread 20, which is consequently heated. Once a sufficient temperature has been attained, a tension force F is applied to the fabric 1 in a direction along the warp threads 10*a*-10*f*, and the fabric is drawn to the desired length in the first direction D1.

The voltage source is then controlled to reduce or turn off the current.

The fabric is then allowed to cool sufficiently.

Optionally cooling may be provided by conduction or convection. For example, a cooling liquid, such as water, may be applied to the fabric and/or a cooling gas stream, such as air, may be applied to the fabric.

The size of the fabric may be reduced as follows.

From an expanded state of the heat-shrink polymer from which the warp threads 10*a*-10*f* are formed, the voltage source is controlled to provide a contraction voltage to the conducting thread 20, which is consequently heated. Once a sufficient temperature has been attained, it is ensured that the warp threads are practically unloaded, such that the warp threads can contract to the desired length. Once the desired contraction has been attained, the voltage source is controlled to reduce or turn off the current.

The fabric is then allowed to cool sufficiently.

Optionally cooling may be provided by conduction or convection. For example, a cooling liquid may be applied to the fabric and/or a cool gas stream, such as air, may be applied to the fabric.

Optionally, one or more temperature sensors may be arranged on the fabric and operatively connected to the controller to provide feedback of the fabric's 1 temperature, such that the current supplied to the conducting thread may be more accurately controlled.

Figure 2:
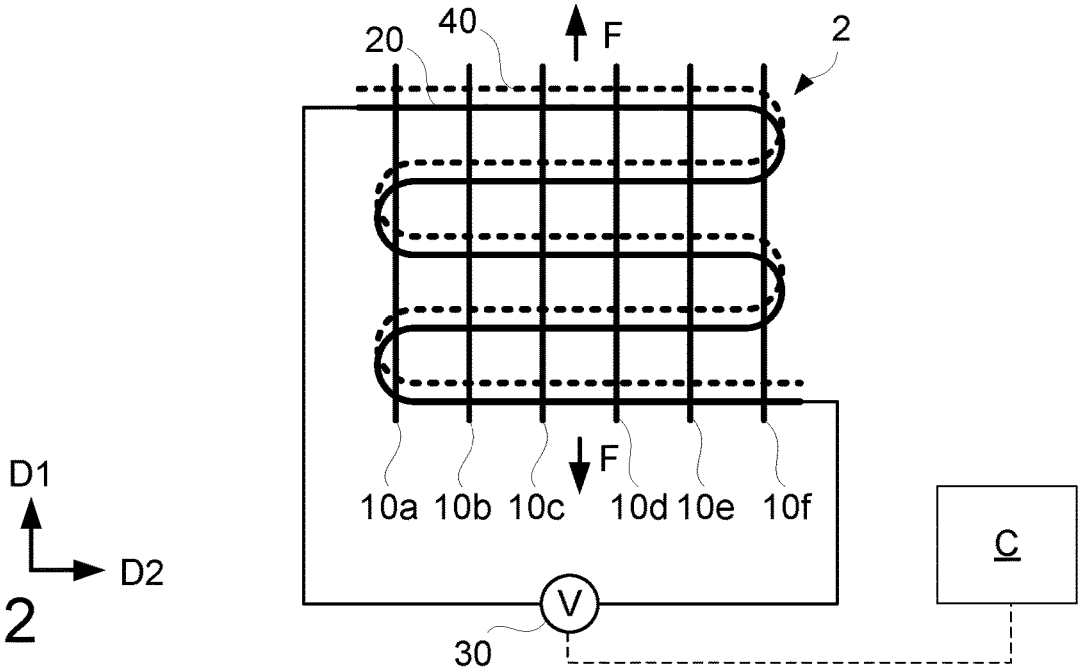
FIG. 2 is a schematic illustration of a second embodiment of a size-adjustable woven fabric.

FIG. 2 schematically illustrates an embodiment of a size-adjustable fabric 2, which is identical to that described with reference to FIG. 1, but which includes at least one, preferably several, additional weft threads 40.

The additional weft thread or weft threads 40, as the case may be, may be formed of a material which is non-conducting, but which is capable of withstanding such temperatures as are typically generated by the conducting thread 20.

The additional weft thread or weft threads 40 may follow the conducting thread 20 completely or partially.

For example, the additional weft thread may extend (horizontally D2 as seen in FIG. 2) over the same number of warp threads 10*a*-10*f* as the conducting thread 20.

Alternatively, the additional weft thread or weft threads 40 may extend over fewer warp threads 10*a*-10*f* than the conducting thread 20.

As yet another alternative, the additional weft thread or weft threads 40 may extend over more warp threads 10*a*-10*f* than the conducting thread 20.

Moreover, as seen along the warp direction D1, the additional weft thread or weft threads' 40 extent in the cross direction D2 may vary.

Figure 3:
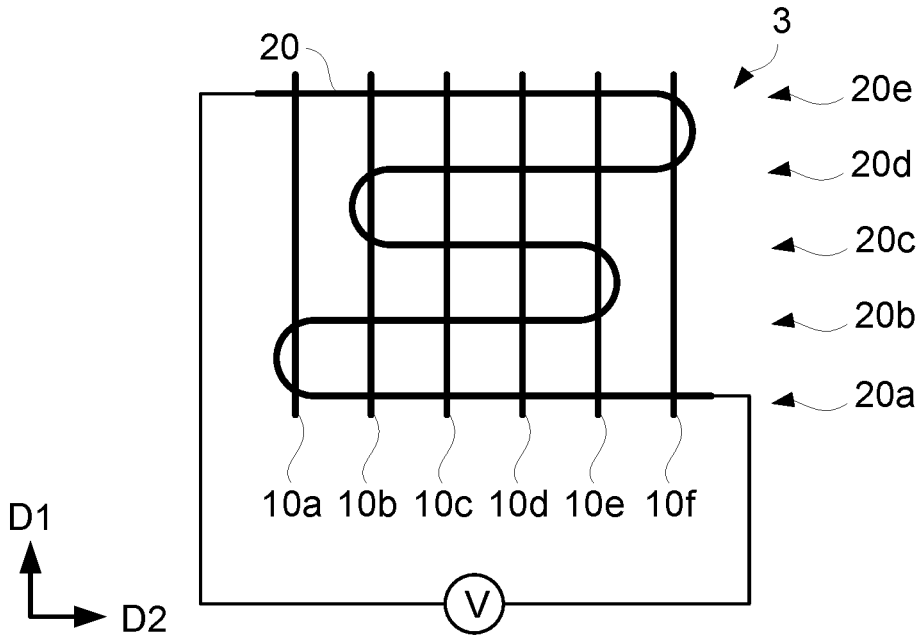
FIG. 3 is a schematic illustration of a third embodiment of a size-adjustable woven fabric.

FIG. 3 schematically illustrates a size-adjustable fabric 3, in which the extent of the conducting thread 20 varies in the direction D2 across the warp threads 10*a*-10*f*.

For example, the conducting thread 20 may, in some rows 20*a*, 20*e* extend across all warp threads 10*a*-10*f*.

In other rows 20*b*, 20*c*, 20*d*, the conducting thread 20 may extend over a subset 10*b*-10*e* of the warp threads.

The size-adjustable fabric 3 illustrated in FIG. 3 may otherwise be identical with those illustrated and described with reference to FIGS. 1 and 2.

Figure 4A:
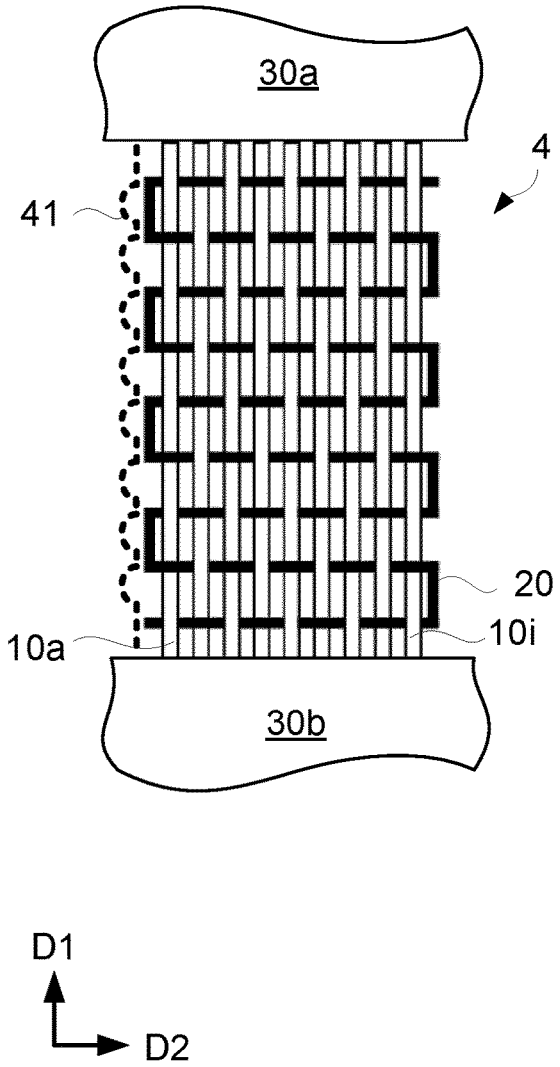
FIGS. 4*a* and 4*b* schematically illustrate a size-adjustable woven fabric in an original state and in an expanded state, respectively.
Figure 4B:
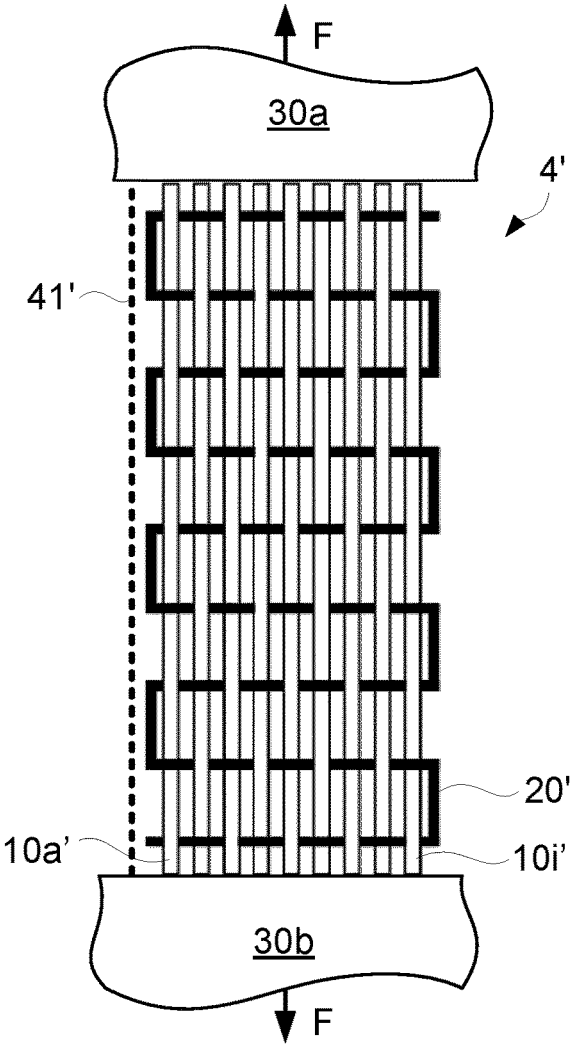

FIGS. 4*a* and 4*b* schematically illustrate the operation of a size-adjustable fabric, such as the ones illustrated in any of FIGS. 1-3.

In FIGS. 4*a*-4*b*, there is schematically illustrated how the adjustable fabric 4, 4' is attached to respective non-adjustable, fixed size, fabric portions 30*a*, 30*b*, such that the adjustable fabric 4, 4' forms a connection between the non-adjustable fabric portions 30*a*, 30*b*.

FIGS. 4*a*-4*b* illustrate a size-adjustable fabric 4, 4' having eight warp threads 10*a*-10*i*. FIG. 4*a* illustrates the fabric 4 in its original state and FIG. 4*b* illustrates the fabric 4' in its expanded state, wherein the warp threads have been stretched and subsequently cooled, as described with reference to FIG. 1.

In FIGS. 4*a*-4*b*, the warp threads 10*a*-10*i* extend at an angle of 80-100 degs, preferably about 90 degs, to edges of the fabric portions 30*a*, 30*b*.

In FIGS. 4*a*-4*b*, there is further illustrated an expansion-limiting thread 41, 41', which may be included in the woven material such that it runs in parallel with the warp threads 10*a*-10*i*, and such that it, in between weft thread 20 crossings, presents slack portions.

With the expansion-limiting thread 41, 41' being formed from a non-heat-shrink material, or from a material that is less prone to heat expansion or heat shrinking than the warp material, once the fabric has been expanded, as illustrated in FIG. 4*b*, to such an extent that the expansion-limiting thread 41, 41' becomes stretched, there will be no further expansion of the fabric 4'.

Figure 5A:
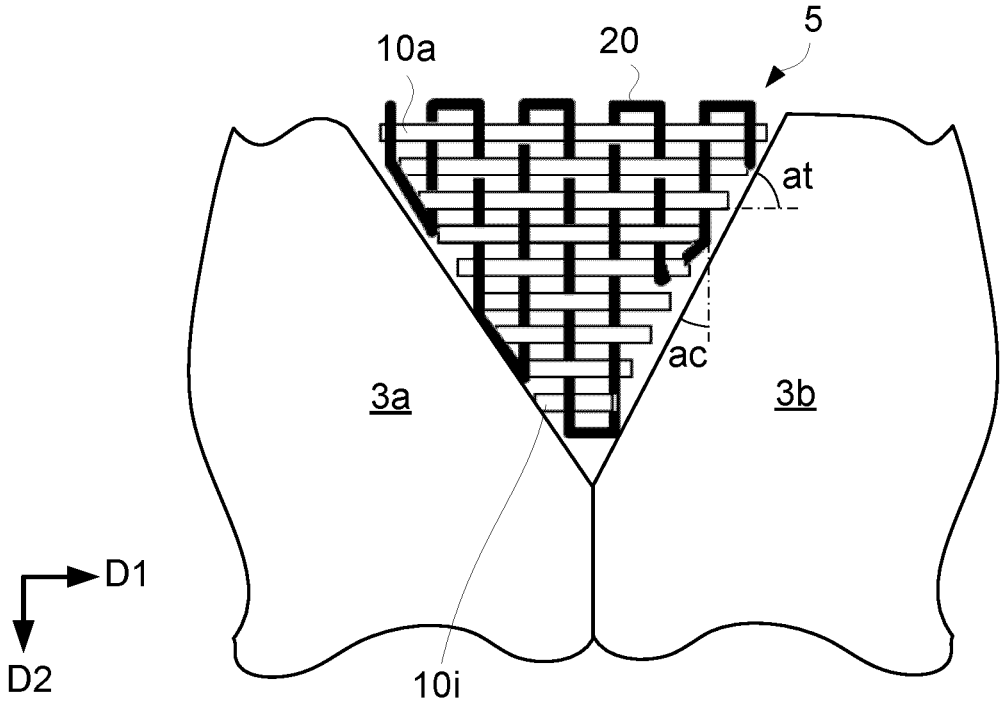
FIGS. 5*a* and 5*b* schematically illustrate another embodiment of a size-adjustable woven fabric in an original state and in an expanded state, respectively.
Figure 5B:
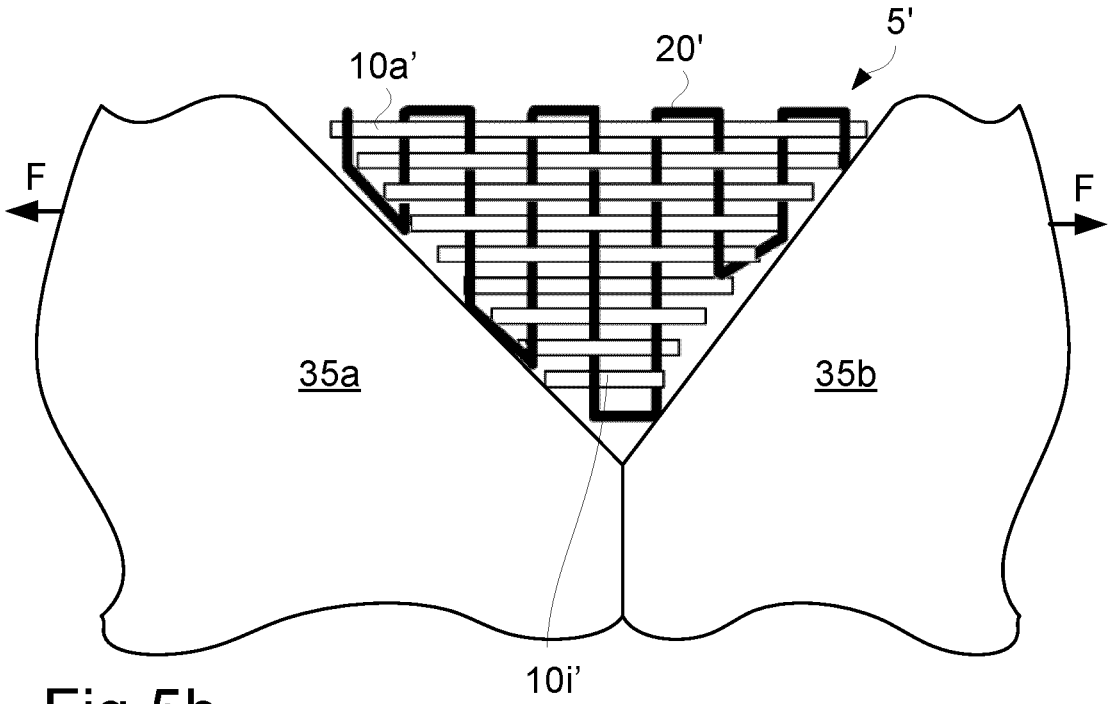

A plurality of such expansion limiting threads 41, 41' may be included at regular intervals among the first set of threads 10*a*-10*i*. FIGS. 5*a*-5*b* schematically illustrate the operation of a size-adjustable fabric 5, 5', which is essentially as described with reference to FIG. 3, i.e. where the extent of the conducting thread 20 across the warp threads 10*a*-10*i* varies along the warp direction D1.

In FIGS. 5*a*-5*b*, there is schematically illustrated how the adjustable fabric 5, 5' is attached to respective non-adjustable, fixed size, fabric portions 35*a*, 35*b*, such that the adjustable fabric 5, 5' forms a connection between the non-adjustable fabric portions 35*a*, 35*b*. In the size-adjustable fabric 5, 5' of FIGS. 5*a*-5*b*, the length of the warp threads 10*a*-10*i* also varies, such that the fabric 5, 5' can be given a desired shape, such as triangular, as illustrated.

Expansion limiting threads, as illustrated in FIGS. 4*a*-4*b* may also be included in the embodiment of FIGS. 5*a*-5*b*.

In FIGS. 5*a*-5*b*, edges of the fabric portions 35*a*-35*b* are non-parallel, and may intersect, so as to form a wedge shape.

The adjustable fabric, 5, 5' may be arranged relative to edges of the fabric portions 35*a*, 35*b* such that an angle at between the first set of threads 10*a*-10*i*, 10*a*'-10*i*' and the fabric edge is greater than an angle $a_c$ between the fabric edge and the conducting threads 20.

Figure 6:
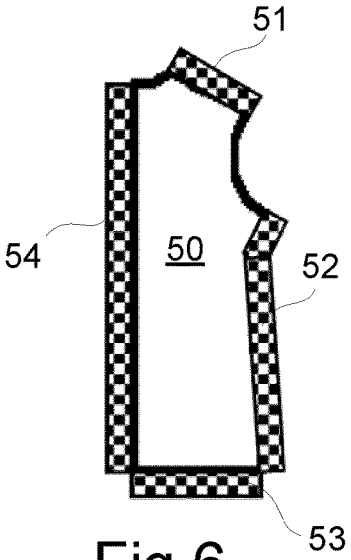
FIG. 6 schematically illustrates an upper body garment back piece having a plurality of portions of size-adjustable woven fabrics.

FIG. 6 schematically illustrates a back part 50 of an upper body garment.

In FIG. 6, there is illustrated a shoulder seam edge area 51, a side seam edge area 52, a bodice length seam edge area 53 and a center back seam edge area 54.

A size adjustable fabric portion 1, 2, 3 may be arranged at any one or more of these edge areas 51, 52, 53, 54, such that the size-adjustable fabric portion is connected, e.g. by stitching, to the back part 50 at the respective edge area 51, 52, 53, 54, such that the warp threads extend at a greater angle at (see FIGS. 5*a*-5*b*) to the respective edge of the back part 50 than the conducting thread 20 portions.

Figure 7:
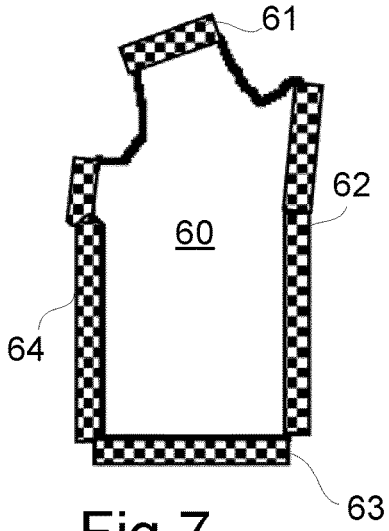
FIG. 7 schematically illustrates an upper body garment front piece having a plurality of portions of size-adjustable woven fabrics.

FIG. 7 schematically illustrates a front part 60 of an upper body garment.

In FIG. 7, there is illustrated a shoulder seam edge area 61, a center front seam edge areas 62, a bodice length seam edge area 63 and a side seam edge area 64.

A size adjustable fabric portion 1, 2, 3 may be arranged at any one or more of these edge areas 61, 62, 63, 64, such that the size-adjustable fabric portion is connected, e.g. by stitching, to the front part 60 at the respective edge area 61, 62, 63, 64, such that the warp threads extend at a greater angle to the respective edge of the front part 60 than the conducting thread 20 portions.

Figure 8:
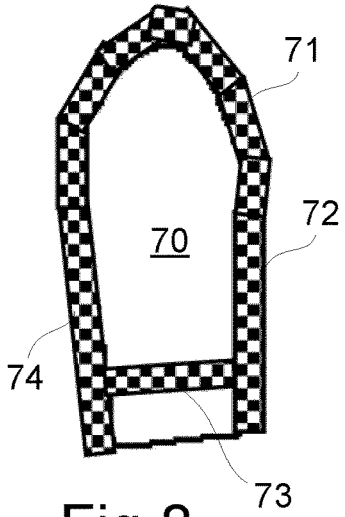
FIG. 8 schematically illustrates an upper body garment sleeve piece having a plurality of portions of size-adjustable woven fabrics.

FIG. 8 schematically illustrates a sleeve part 70 of an upper body garment.

In FIG. 8, there is illustrated a sleeve cap seam edge area 71, sleeve longitudinal seam edge areas 72, 74 and an elbow line seam area 73.

A size adjustable fabric portion 1, 2, 3 may be arranged at any one or more of these areas 71, 72, 73, 74, such that the size-adjustable fabric portion is connected, e.g. by stitching, to the sleeve part 70 at the respective edge area 71, 72, 73, 74, such that the warp threads extend at a greater angle to the respective edge of the sleeve part 70 than the conducting thread 20 portions.

Hence, by arranging a size-adjustable fabric 1, 2, 3 portion having appropriate shape and size, between and interconnecting two garment pieces 50, 60, 70, it is possible to make the garment size-adjustable.

For example, size adjustable fabric portions 1, 2, 3 can be included in any vertically, as seen when the garment is worn by a standing wearer, running seam area 52, 54; 62, 64 to provide adjustability of chest and/or waist size.

The position and/or width of a sleeve may likewise be adjustable by inclusion of one or more adjustable-size fabric 1, 2, 3 portions in the sleeve cap seam edge area 71 and/or in the longitudinal seam edge area 72, 74.

The length of an arm may be adjustable by inclusion of one or more adjustable-size fabric 1, 2, 3 portions running across the longitudinal direction of the arm, such as in the elbow line seam area 73.

Figure 9:
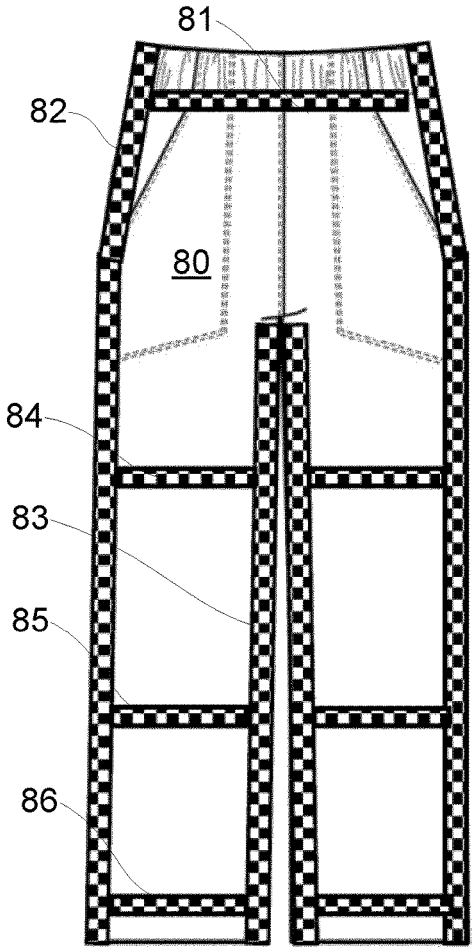
FIG. 9 schematically illustrates a lower body garment front piece having a plurality of portions of size-adjustable woven fabrics.

FIG. 9 schematically illustrates a front part 80 of a pair of pants.

In FIG. 9, there is illustrated a body rise seam area 81, a side seam area 82, an inside leg seam area 83, an upper knee line seam area 84, a lower knee line seam area 85 and a lower cross seam area 86, closer to a lower end of the pant leg than to the knee portion of the pant leg.

Figure 10:
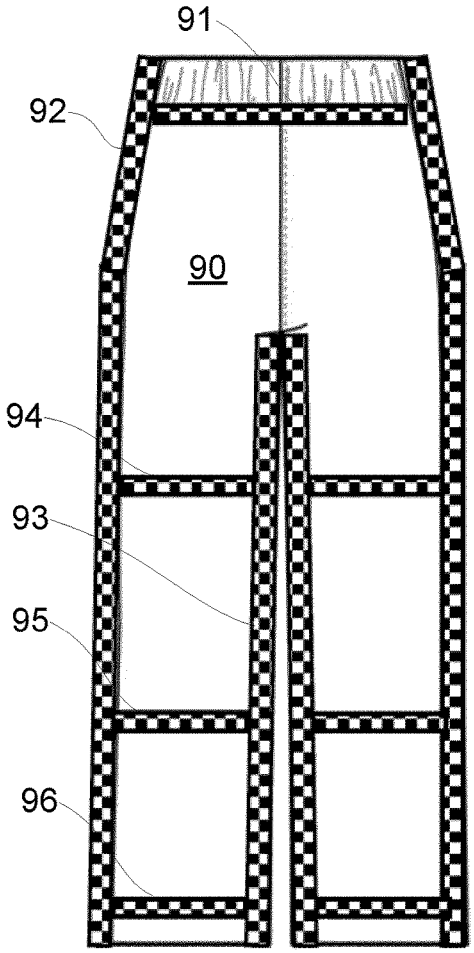
FIG. 10 schematically illustrates a lower body garment back piece having a plurality of portions of size-adjustable woven fabrics.

Likewise, FIG. 10 schematically illustrates a back part 90 of a pair of pants.

In FIG. 10, there is illustrated a body rise seam area 91, a side seam area 92, an inside leg seam area 93, an upper knee line seam area 94, a lower knee line seam area 95 and a lower cross seam area 96, closer to a lower end of the pant leg than to the knee portion of the pant leg.

Hence, by introducing a size-adjustable fabric portion 1, 2, 3 at the body rise seam area 81, 91, with the warp threads

10*a*-10*i* extending vertically, it is possible to adjust the vertical position of the waist of the pants.

By instead introducing a size-adjustable fabric portion 1, 2, 3 at the body rise seam area 81, 91, with the warp threads 10*a*-10*i* extending horizontally, as seen when the garment is worn by a standing wearer, it is possible to adjust the width of the waist of the pants.

By introducing a size-adjustable fabric portion 1, 2, 3 at all or part of side seam area 82, 92, it is possible to adjust waist, hip and/or leg width of the pants.

By introducing a size-adjustable fabric portion 1, 2, 3 at an inside leg seam area 83, 93, it is possible to adjust leg width of the pants.

By introducing a size-adjustable fabric portion 1, 2, 3 at a cross seam area 84, 85, 86; 94, 95, 96, it is possible to adjust length of the of the pant leg.

By introducing size-adjustable fabric portions 1, 2, 3 at cross seam areas 84, 85; 94, 95 above and below the knee of the pants, it is possible to adjust a knee position of the pants, e.g. in order to optimize the position of a knee protector that is integrated with the pants.

In each of the embodiments disclosed above, it is possible to introduce two or more sections of conducting threads, which are separated, such that different fabric sections along the warp direction may be controlled separately.

In various alternatives disclosed above, it is possible to introduce two or more sections of conducting threads, which are separated, such that different fabric sections across the warp direction may be controlled separately.

In various alternatives disclosed above, it is possible to introduce two or more conducting threads which can be separately controlled to provide more or less heat to the same fabric section.

A size-adjustable fabric may be included in various applications, examples of which will be provided in the following.

Size-adjustable fabric patches may be included in clothing, such as fashion clothing/sports fashion clothing, in order to provide resizeability and/or adjustability. Example garments include trousers, jeans, jackets, blazers, shirts, shorts, dresses and skirts. Also leather goods, such as purses, handbags and shoes may include one or more size-adjustable fabric patches.

Size-adjustable fabric patches may be included in sportswear, such as outdoor jackets, skiing jackets/skiing suits, outdoor bags, tent textiles and protective textile covers. Protective textile cover can be a cover to hide in up in the mountains/hill. A helicopter can throw it down to people to protect themselves in meanwhile help is on the way.

Size-adjustable fabric patches may be included in kidswear, such as pants, jackets, overalls, one-piece suits an bags.

Size-adjustable fabric patches may be included in underwear, such as in corsets, brassieres or boxer shorts.

Size-adjustable fabric patches may be included in motorsportwear, such as in biking suits, motorcycle costumes, motorcycle jackets, motorcycle pants, etc.

Size-adjustable fabric patches may be included in interior articles, such as furniture or curtains. For example, covers for sofas or armchairs, curtains, bedding textiles, textile covers or carpets.

Size-adjustable fabric patches may be included in industrial applications, such as seat covers for cars, airplanes, boat cushions and in sail textiles.

Size-adjustable fabric patches may be included in workwear, e.g. workwear for carpenters in the form of dungarees or overalls.

Size-adjustable fabric patches may be included in protective wear, such as in harnesses, gloves, cooling vests and protection gear for water blasting, bullet-proof garments, stab-proof garments, etc.

Size-adjustable fabric patches may be included in footwear, such as in boots, sneakers or leather shoes.

Size-adjustable fabric patches may be included in medical applications, such as in clothing worn by hospital staff, or in supporting garments, such as rehabilitation socks, etc.

Size-adjustable fabric patches may be included in military or similar wear, such as in pilot suits, diving suits, as well as in space suits.

Figure 11:
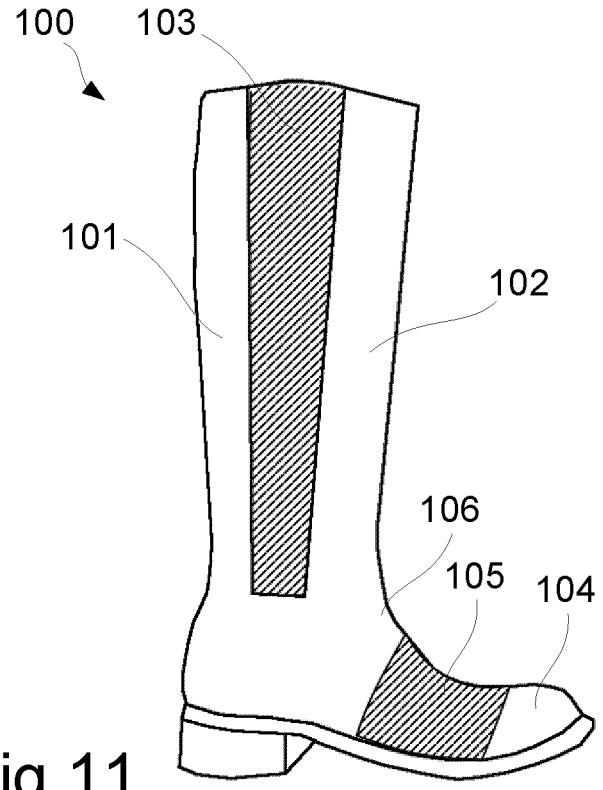
FIG. 11 schematically illustrates a footwear having patches of size-adjustable woven fabric.

In FIG. 11, there is illustrated an embodiment of a footwear, which is provided with two patches 103, 105 of size-adjustable fabric as described above.

A first patch 103 is provided on the shaft of the boot with a view to providing adjustability of a circumference of the shaft, such that the circumference of the shaft can be adjusted to fit wearers having differently sized and/or shaped calves.

Hence, the shaft of the boot may comprise a pair of shaft portions 101, 102, which are separated along a vertical direction (when the boot is positioned on a horizontal surface) by the patch 103 of size-adjustable fabric. The size-adjustable fabric is thus connected to the shaft portions 101, 102 such that the first set of threads 10*a* (see FIGS. 5*a*-5*b*) extends between the shaft portions 101, 102, such as substantially horizontally.

The conducting thread 20 (FIGS. 5*a*-5*b*) extends substantially perpendicular to the first set of threads 10*a*, such as substantially horizontally.

Hence, using the principles described above, by heating the first set of threads, the distance between the shaft portions 101, 102 can be adjusted so as to enable the shaft of the boot to fit a user's calf perfectly.

It is also possible to arrange two or more vertically juxtaposed patches 103 between the shaft portions 101, 102, such that different portions of the shaft may be individually adjustable.

The patch 103 may be positioned at a rear portion of the shaft, at a side portion of the shaft or at a front portion of the shaft.

The patch may be arranged in a concealed manner, such that the size-adjustable fabric may be hidden by a piece of material so as to provide for a desired aesthetic appearance and/or for preventing penetration of dirt or moisture.

In FIG. 11 there is also illustrated a second patch 105 of size-adjustable fabric just rear of the toe box 104, as part of the vamp 106, instep or tongue.

This second patch 105 may be connected to the toe box 104 and to the vamp/instep/tongue. The second patch 105 may be oriented such that the first set of threads run substantially along the width of the boot, whereby a width and/or height of the boot 100 may be adjustable.

It is conceivable to provide a footwear having only the first patch 103, only the second patch 105 or both patches 103, 105.

In the case of boots having a shaft, and in particular a shaft which extends partially or wholly along the user's calf, such boots may be provided, as non-limiting examples, for functional boots, such as riding boots or motorcycle boots and for fashion boots, in particular women's boots.

Lower boots, such as ski boots, working boots or hiking boots, may also be provided one or both patches 103, 105.

The patches 103, 104 may be provided as part of the actual shoe casing, and/or as part of a shoe liner (not shown), such as is often found in e.g. slalom boots.

Shoes, which do not extend upwardly beyond the heel or the ankle, may be provided with the second type of patch 105.

The parts of the footwear which are not made up of the patches 103, 105 may be formed of a material such as leather, rubber or reinforced rubber, polymer material or reinforced polymer material or fabric (woven, non-woven).

Figure 12:
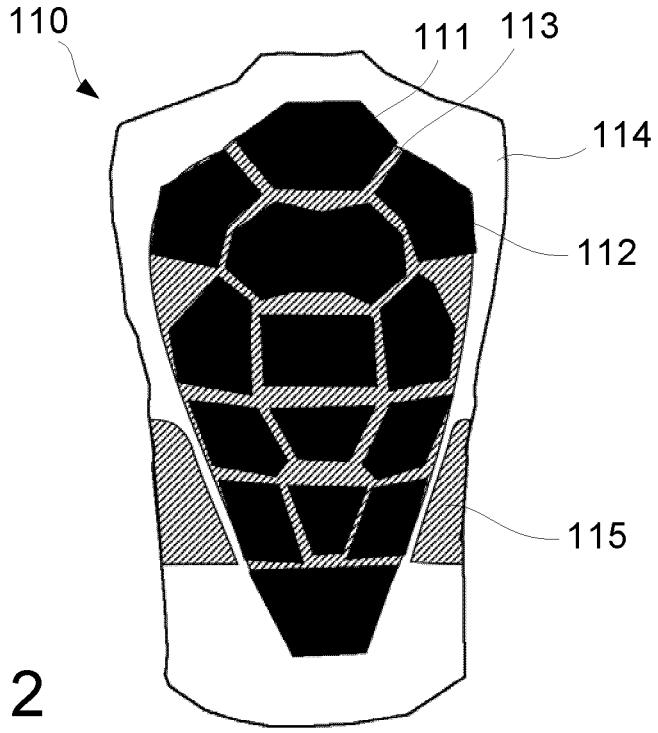
FIG. 12 schematically illustrates a protective wear having patches of size-adjustable woven fabric.

In FIG. 12, there is illustrated a protective wear in the form of a back protector 110 for use in skiing or motorcycle riding.

The back protector 110 comprises two or more protecting bodies 111, 112, which may be relatively rigid bodies intended to absorb and/or distribute shock, and/or to protect against penetration of sharp objects or edges.

A patch of size-adjustable fabric 113 as disclosed above may be arranged between the protecting bodies 111, 112, such that a distance between the protective bodies 111, 112 is adjustable. Hence, it is possible to provide size adjustability of the protective wear, such that its protective capability can be optimized for each individual user.

It is understood that as a protective wear may comprise a plurality of protecting bodies 111, 112, a patch 113 of size-adjustable fabric may be arranged along any border area between protective bodies 111, 112 and that each such patch may be individually controllable. It is also possible to provide size-adjustable fabric at some such border areas while providing rigid or elastic fabric in other border areas.

It is also possible to provide one or more patches 115 at waist or shoulder areas of the protective wear, so as to enable a perfect fit also at such areas of the user.

The protective wear 110 may be a back protector and/or a front protector.

It is also possible to provide the protective wear 110 in the form of shoulder protectors, knee protectors, arm protectors, or the like, for use in e.g. ice hockey, skiing, motorcycling, and riding.

Other applications may include riot wear to be used by police or military, or for ballistic protection wear.

Figure 13:
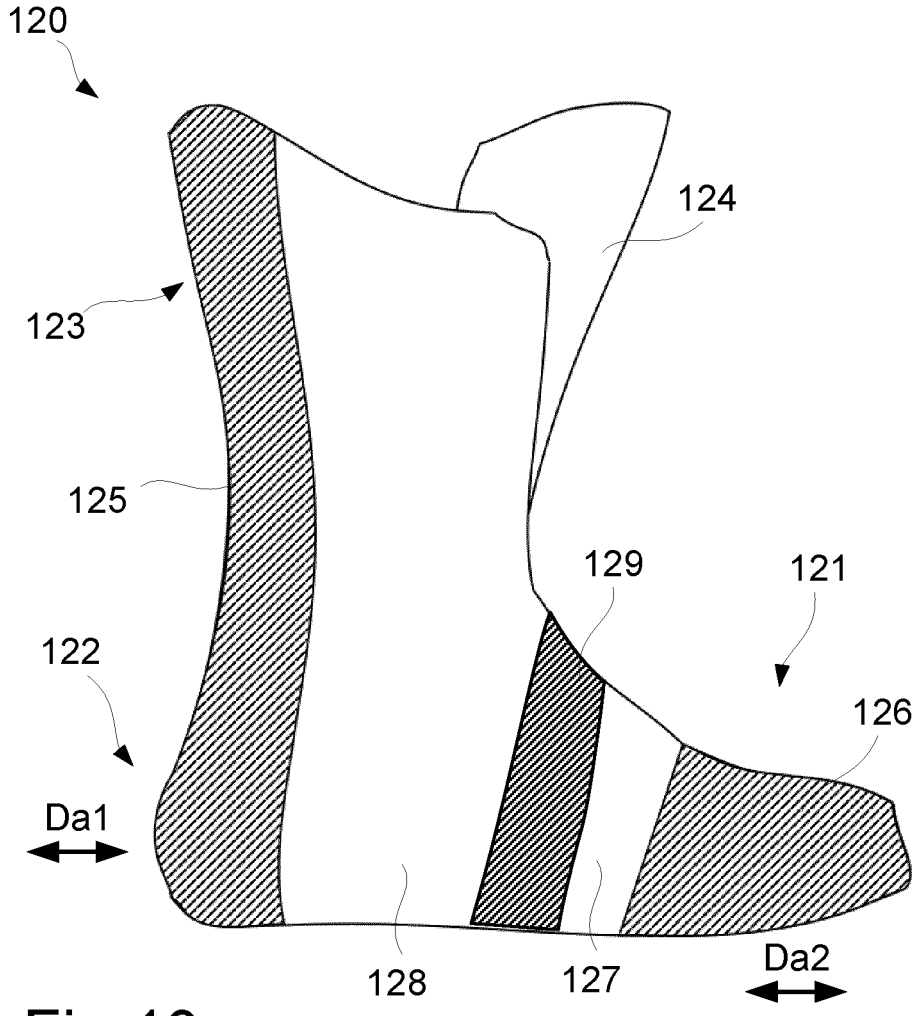
FIG. 13 schematically illustrates a footwear.

FIG. 13 schematically illustrates a footwear 120, which may take the form of a lining for a footwear, such as a boot, in particular for skiing, such as a slalom or telemark, or for snowboarding. It is understood that such linings may also be used in other types of footwear, such as, but not limited to, riding boots, motorcycle boots, hunting boots, hiking boots, rain boots (wellingtons) or fashion boots.

The footwear 120 may have a toe portion 121, a heel portion 122, a wrist portion 123 and a tongue portion 124.

For example, at the toe portion 121, one or more size-adjustable fabric patches or material portions 126 may be provided with the first set of threads 10*a* extending in a direction Da2 that is substantially parallel to a length direction of the footwear, such that a length of the footwear is adjustable. In particular, a toebox of the footwear may be produced from the size-adjustable fabric, such that the space made available for the wearer's toes may be perfectly adjusted.

It is also possible to arrange a patch 129 of size-adjustable fabric at a vamp or instep portion of the footwear, while a toebox is formed of a conventional fixed-size material. The first set of threads 10*a* may thus extend in a direction that is substantially parallel to a length direction of the footwear, such that the length of the footwear can be adjusted by adjusting a position of the toebox relative to a remainder of the footwear.

It is also possible to provide one or more size-adjustable fabric patches 125 at the heel portion 122, such that a length of the liner 120 can be adjusted. To this end, the first set of threads 10*a* (see FIGS. 5*a*-5*b*) may extend substantially horizontally.

It is also possible to provide one or more size-adjustable fabric patches 125 at the wrist portion 123, such that a wrist width of the liner 120 can be adjusted. To this end, the first set of threads 10*a* (see FIGS. 5*a*-5*b*) may extend substantially horizontally.

In one embodiment, a size-adjustable fabric patch extends all along the back of the footwear, such as from the footbed to a collar of the footwear, with its first set of threads 10*a* extending substantially horizontally.

Such a footwear may be adjusted to fit a user by supplying a current through the second set of threads 10*b* so as to heat the size-adjustable fabric, and fitting the footwear to the user, whereby the first set of threads 10*a* are allowed to cool while the footwear is worn by the user.

The feeding of power may take place before the footwear is fitted by the user, or while the footwear is being worn by the user.

A footwear as described above may be provided with one or more of the patches 12'5, 126, 129 as described above.

The invention claimed is:

1. A wearable item comprising:

a first flexible fixed-size fabric portion, a second flexible fixed-size fabric portion, and a patch, formed of a size-adjustable fabric comprising:

a first set of threads, each formed of a heat-shrink polymer material, at least one conducting thread, formed of an electrically conducting material, wherein the first set of threads (10*a*-10*i*) runs substantially parallel with each other, and wherein the conducting thread (20) runs substantially across the first set of threads wherein the patch is arranged between and connecting said first and second fixed-size fabric portions, wherein the first set of threads extend at a greater angle to at least one of the first and second fixed-size fabric portions than the conducting thread.

2. The wearable item as claimed in claim 1, wherein the first set of threads forms a set of warp threads, and wherein the conducting thread forms a weft thread.

3. The wearable item as claimed in claim 1, wherein the conducting thread extends at an angle of 80-100 degs to the first set of threads.

4. The wearable item fabric as claimed in claim 1, wherein the heat-shrink polymer material comprises as least one material selected from a group consisting of a polyolefin, a polyester, a polyvinyl chloride (PVC), a fluorocarbon-based synthetic rubber, a polychloroprene rubber, a polytetrafluoroethylene (PTFE), an elastomer, a fluorinated ethylene propylene (FEP) and a polyvinylidene fluoride (PVDF).

5. The wearable item fabric as claimed in claim 1, wherein the heat-shrink polymer material is a crosslinked and subsequently expanded polymer material.

6. The wearable item fabric as claimed in claim 1, further comprising at least one non-conducting thread, which extends mainly parallel with the conducting thread.

7. The wearable item as claimed in claim 1, wherein the conducting thread runs across the entire first set of threads (10*a*-10*i*).

8. The wearable item as claimed in claim 1, wherein the conducting thread, at least at some section along a length direction of the first set of threads, runs across less than all threads of the first set of threads.

9. The wearable item as claimed in claim 1, wherein the threads of the first set of threads present at least two different lengths.

10. The wearable item as claimed in claim 1, further comprising at least one expansion limiting thread, which extends parallel with the first set of threads, wherein the expansion limiting thread, when the first set of threads are in a contracted state, present curved portions between crossing portions of the conducting thread.

11. A footwear, comprising:

a first flexible fixed-size material portion, a second flexible fixed-size material portion, and a patch, formed of a size-adjustable fabric, comprising: a first set of threads, each formed of a heat-shrink polymer material, at least one conducting thread, formed of an electrically conducting material, wherein the first set of threads runs substantially parallel with each other, and wherein the conducting thread runs substantially across the first set of threads, wherein the patch is arranged between and connecting said first and second fixed-size material portions, wherein the patch is positioned at a shaft portion of the footwear, and wherein the first set of threads extend substantially along a circumference direction of a shaft of the footwear, such that a shaft width is adjustable.

12. The footwear as claimed in claim 11, wherein the conducting thread, at least at some section along a length direction of the first set of threads, runs across less than all threads of the first set of threads.

13. The footwear as claimed in claim 11, further comprising at least one non-conducting thread, which extends mainly parallel with the conducting thread.

14. The footwear as claimed in claim 11, further comprising at least one expansion limiting thread, which extends parallel with the first set of threads, wherein the expansion limiting thread, when the first set of threads are in a contracted state, present curved portions between crossing portions of the conducting thread.

15. A protective wear, comprising:

a first protecting body, a second protecting body, and a patch (113), formed of a size-adjustable fabric, comprising: a first set of threads, each formed of a heat-shrink polymer material, at least one conducting thread, formed of an electrically conducting material, wherein the first set of threads runs substantially parallel with each other, and wherein the conducting thread runs substantially across the first set of threads, wherein the patch is arranged between and connecting said first and second protecting bodies, and wherein the first set of threads extend substantially between the first and second protecting bodies, such that a distance between the protecting bodies is adjustable.

16. The protective wear as claimed in claim 15, wherein the conducting thread, at least at some section along a length direction of the first set of threads, runs across less than all threads of the first set of threads.

17. The protective wear as claimed in claim 15, wherein at least one of the protective first and second bodies includes ballistic protection material.

18. The footwear as claimed in claim 15, further comprising at least one non-conducting thread, which extends mainly parallel with the conducting thread.

19. The footwear as claimed in claim 15, further comprising at least one expansion limiting thread, which extends parallel with the first set of threads, wherein the expansion limiting thread, when the first set of threads are in a contracted state, present curved portions between crossing portions of the conducting thread.

* * * * *